US007141342B2

(12) United States Patent
Toyoda et al.

(10) Patent No.: US 7,141,342 B2
(45) Date of Patent: Nov. 28, 2006

(54) MAGENTA TONER AND PROCESS FOR PRODUCING MAGENTA TONER

(75) Inventors: Takayuki Toyoda, Yokohama (JP); Yasuaki Murai, Kawasaki (JP); Takeshi Miyazaki, Yokohama (JP); Norikazu Fujimoto, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 11/206,865

(22) Filed: Aug. 19, 2005

(65) Prior Publication Data

US 2005/0277042 A1 Dec. 15, 2005

Related U.S. Application Data

(63) Continuation of application No. PCT/JP05/04025, filed on Mar. 2, 2005.

(30) Foreign Application Priority Data

Mar. 3, 2004 (JP) ..... 2004-058671

(51) Int. Cl.
*G03G 9/09* (2006.01)

(52) U.S. Cl. ..... 430/108.14; 430/108.21; 430/137.15

(58) Field of Classification Search ..... 430/108.21, 430/137.15, 108.14
See application file for complete search history.

(56) References Cited

U.S. PATENT DOCUMENTS 4,847,177 A * 7/1989 Raue et al. ..... 430/108.21
4,869,989 A * 9/1989 Raue et al. ..... 430/108.21
4,933,250 A * 6/1990 Nakayama et al. .... 430/108.21
5,554,471 A * 9/1996 Bertrand et al. ..... 430/45
5,693,445 A * 12/1997 Yamaga et al. ..... 430/108.21
2005/0178289 A1* 8/2005 Murai et al. ..... 106/31.43

FOREIGN PATENT DOCUMENTS

JP 1-224777 A 9/1989
JP 2-213854 A 8/1990
JP 2-311873 A 12/1990
JP 2916835 B2 4/1999
JP 2000-248191 A 9/2000

* cited by examiner

*Primary Examiner*—Christopher Rodee
(74) *Attorney, Agent, or Firm*—Fitzpatrick Cella, Harper & Scinto

(57) ABSTRACT

This invention provides a magenta toner obtaining a sharp color and having a high coloring power and superior transparency and light-fastness. The magenta toner of the present invention is characterized by having magenta toner particles containing at least a coloring compound having a structure represented by the following Formula (1)

Formula (1)

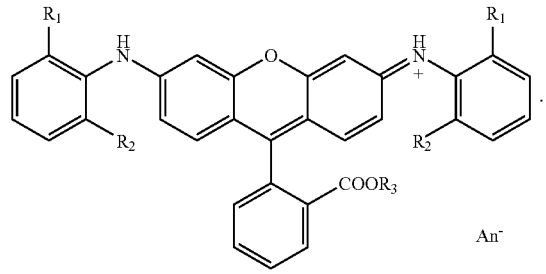

6 Claims, No Drawings

MAGENTA TONER AND PROCESS FOR PRODUCING MAGENTA TONER

This application is a continuation of International Application No. PCT/JP2005/004025, filed Mar. 2, 2005, which claims the benefit of Japanese Patent Application No. 2004-058671, filed Mar. 3, 2004.

BACKGROUND OF THE INVENTION

1. Field of the Invention

This invention relates to a magenta toner used in full-color copying machines and printers for developing electrostatic latent images in electrophotography, electrostatic recording, electrostatic printing and so forth, and to a process for producing the magenta toner.

2. Related Background Art

Conventionally, electrostatic printing, electrophotography and so forth are available as processes for developing electrostatic latent images by the use of toners to form visible images. In these processes, electrostatic latent images are formed on a photosensitive member, subsequently the electrostatic latent images are developed by the use of toners to form toner images, then the toner images are transferred to a transfer material such as paper as occasion calls, and thereafter the toner images are fixed by the action of heat, pressure, heat-and-pressure, solvent vapor or the like to obtain copies or prints.

In recent years, in image forming apparatus such as copying machines and printers, the evolution from monochrome colors to full colors is being in rapid progress, where full-color image forming apparatus have been put into practical use and it has become able to obtain high-quality images which are of course superior in resolution and gradation and also in color reproducibility free of color non-uniformity.

For example, in full-color copying machines, a color-image original is color-separated into B (blue), G (green) and R (red) with use of corresponding color filters, and thereafter latent images formed of dots of 20 to 70 μm in diameter which correspond to an original image are developed by the use of respective-color toners of Y (yellow), M (magenta), C (cyan) and B (black), utilizing the action of subtractive color mixing.

As conventional magenta colorants for electrophotography, proposed are quinacridone pigments, anthraquinone pigments, thioindigo pigments, xanthene dyes, xanthene pigments, azo dyes, azo pigments and so forth (Japanese Patent Publications No. S49-46951 and No. S55-42383, and Japanese Patent Applications Laid-open No. S55-26574, No. S59-57256 and No. 2000-248191). In particular, xanthene dyes are preferred in view of chroma and brightness. However, the xanthene dyes have had a problem on fastness such as light-fastness. To solve such a problem, phenylxanthene dyes substituted with a branched alkyl group are proposed, which, however, have solubility in water or are insufficiently soluble in polymerizable monomers, and hence it has been difficult for them to be used in direct suspension polymerization (Japanese Patent No. 02916835).

A method is also known in which, in order to further control colorant transparency and color tints, a coloring compound is not used alone, and a pigment and a pigment, or a pigment and a dye, are mixed, or a quinacridone pigment is used in the state of mixed crystals (see Japanese Patent Applications Laid-open No. H1-224777 and No. S62-291669).

These magenta colorants have good affinity for binder resins and good light-fastness, and can provide magenta toners having superior triboelectric charging characteristics and color tones. However, as the full-color image forming apparatus have become more highly functional in recent years, magenta toners are demanded to be more improved in color tones, chroma, transparency, electrophotographic performance and so forth.

SUMMARY OF THE INVENTION

An object of the present invention is to provide a magenta toner having solved such problems discussed above.

More specifically, an object of the present invention is to provide a magenta toner for full-color image formation which can give a sharp color and has superior light-fastness.

Another object of the present invention is to provide a magenta toner having superior transparency in projected images such as OHP transparency images.

Still another object of the present invention is to provide a process for producing the magenta toner having superior properties as stated above.

The present invention is concerned with a magenta toner characterized by having magenta toner particles containing at least a coloring compound having a structure represented by the following Formula (1):

Formula (1)

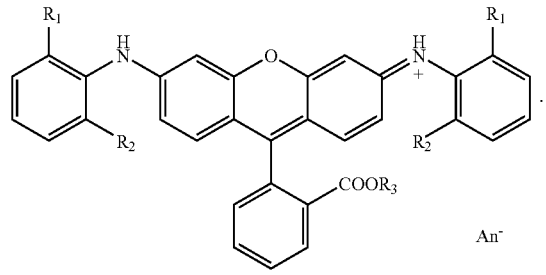

wherein $R_1$ and $R_2$ each independently represent a straight-chain alkyl group having 1 to 4 carbon atoms, $R_3$ represents an alkyl group having 1 to 6 carbon atoms, and $An^-$ represents a counter anion.

The present invention is also concerned with a process for producing a magenta toner, which is a process for producing a magenta toner having magenta toner particles;

the magenta toner particles being polymerization magenta toner particles formed by mixing at least a polymerizable monomer, a coloring compound having a structure represented by the following Formula (1) and a polymerization initiator to prepare a polymerizable monomer composition, dispersing the polymerizable monomer composition in an aqueous medium to form particles of the polymerizable monomer composition, and polymerizing in the aqueous medium a polymerizable monomer contained in the particles of the polymerizable monomer composition:

Formula (1)

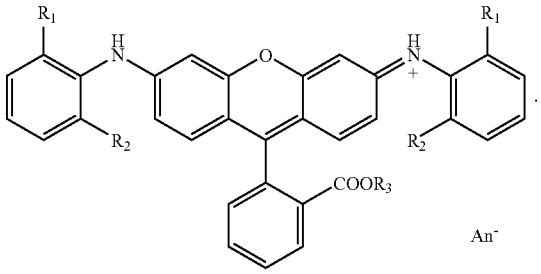

wherein $R_1$ and $R_2$ each independently represent a straight-chain alkyl group having 1 to 4 carbon atoms, $R_3$ represents an alkyl group having 1 to 6 carbon atoms, and $An^-$ represents a counter anion.

According to the present invention, a magenta toner can be obtained which has superior spectral characteristics and also have superior light-fastness. Further, a magenta toner can be provided which has superior transparency in projected images such as OHP transparency images.

According to the present invention, a process for producing a magenta toner can also be provided which has superior properties as stated above.

DESCRIPTION OF THE PREFERRED EMBODIMENTS

The present invention is further described below in detail by giving preferred embodiments. The present inventors have made extensive studies in order to solve the problems the prior art has had. As the result, they have discovered that a coloring compound having a structure represented by the following Formula (1) is a compound which can give a sharp color and has superior light-fastness and transparency, and is useful as a colorant of a magenta toner. Thus, they have accomplished the present invention. In particular, the coloring compound having a structure represented by the following Formula (1) enables control of compatibility with polymerizable monomers by changing the counter ion, anionic species ($An^-$), and is useful when a polymerizable monomer composition is granulated in an aqueous medium and its polymerizable monomer is polymerized to form magenta toner particles.

Formula (1)

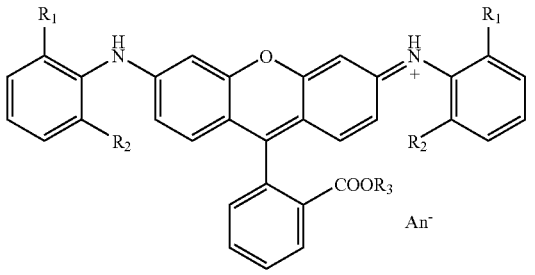

wherein $R_1$ and $R_2$ each independently represent a straight-chain alkyl group having 1 to 4 carbon atoms, $R_3$ represents an alkyl group having 1 to 6 carbon atoms, and $An^-$ represents a counter anion.

The straight-chain alkyl group having 1 to 4 carbon atoms, represented by $R_1$ and $R_2$ in the above Formula (1), may include a methyl group, an ethyl group, a n-propyl group and a n-butyl group. $R_1$ and $R_2$ may be the same or different. In view of color tones, material cost and so forth, preferred is a case in which $R_1$ and $R_2$ are both methyl groups or ethyl groups, and more preferred is a case in which $R_1$ and $R_2$ are both methyl groups.

The alkyl group having 1 to 6 carbon atoms, represented by $R_3$, may also include a methyl group, an ethyl group, a n-propyl group, an isopropyl group, a n-butyl group, a sec-butyl group, a tert-butyl group, a n-pentyl group and a n-hexyl group. In view of material cost, readiness for synthesis and so forth, preferred is that $R_3$ is a methyl group or an ethyl group, and more preferred is a case in which it is an ethyl group.

The $An^-$ in the above Formula (1) may include halide ions (halogenide ions) such as a chloride ion, a bromide ion and an iodide ion, inorganic ions such as a sulfate ion ($SO_4^{2-}$) a perchlorate ion ($ClO_4^-$), a tetrafluoroborate ion ($BF_4^-$) and a hexafluorophosphate ion ($PF_6^-$), fatty acid ions ($R—COO^-$) such as an acetate ion and a propionate ion, and aromatic carboxylate ions ($Ar—COO^-$) such as a benzoate ion and a 1-(or 2-) naphthalene carboxylate ion, and further p-toluenesulfonate ion ($CH_3C_6H_4SO_3^-$), and a methacrylate ion ($CH_2C(CH_3)COO^-$). Preferred are fatty acid ions, a p-toluenesulfonate ion, a methacrylate ion and aromatic carboxylate ions. In particularly, from the viewpoint of solubility in polymerizable monomers, aromatic carboxylate ions are more preferred.

In regard to the coloring compound having the structure represented by the above Formula (1), its exemplary structures are shown in Table 1.

TABLE 1

| | $R_1$ | $R_2$ | $R_3$ | $An^-$ |
|---|---|---|---|---|
| Exemplary Structure 1 | $—CH_3$ | $—CH_3$ | $—C_2H_5$ | $Cl^-$ |
| Exemplary Structure 2 | $—CH_3$ | $—CH_3$ | $—C_2H_5$ | 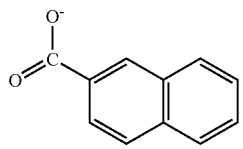 |
| Exemplary Structure 3 | $—CH_3$ | $—CH_3$ | $—C_2H_5$ | 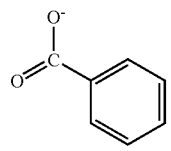 |
| Exemplary Structure 4 | $—CH_3$ | $—CH_3$ | $—C_2H_5$ | 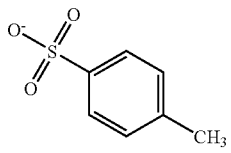 |

TABLE 1-continued

| | $R_1$ | $R_2$ | $R_3$ | $An^-$ |
|---|---|---|---|---|
| Exemplary Structure 5 | $—CH_3$ | $—CH_3$ | $—C_2H_5$ | 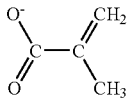 |
| Exemplary Structure 6 | $—CH_3$ | $—CH_3$ | $—C_2H_5$ | $BF_4^-$ |
| Exemplary Structure 7 | $—CH_3$ | $—CH_3$ | $—C_2H_5$ | $PF_6^-$ |
| Exemplary Structure 8 | $—CH_3$ | $—CH_3$ | $—C_2H_5$ | $ClO_4^-$ |
| Exemplary Structure 9 | $—CH_3$ | $—CH_3$ | $n\text{-}C_2H_{13}—$ | $Cl^-$ |
| Exemplary Structure 10 | $—CH_3$ | $—CH_3$ | $n\text{-}C_6H_{13}—$ | $ClO_4^-$ |
| Exemplary Structure 11 | $—C_2H_5$ | $—C_2H_5$ | $—C_2H_5$ | $Cl^-$ |

In the above coloring compounds, from the viewpoint of compatibility with polymerizable monomers, more preferred are the coloring compounds having the structures represented by Exemplary Structure 2 and Exemplary Structure 3, and particularly preferred is the coloring compound having the structure represented by Exemplary Structure 2.

The coloring compound having the structure represented by the above Formula (1) may be synthesized according to a known method. An example of a synthesis scheme is shown below. Incidentally, $R_1$ to $R_3$ in the following Formulas (2) to (4) are the same as those defined in the above Formula (1).

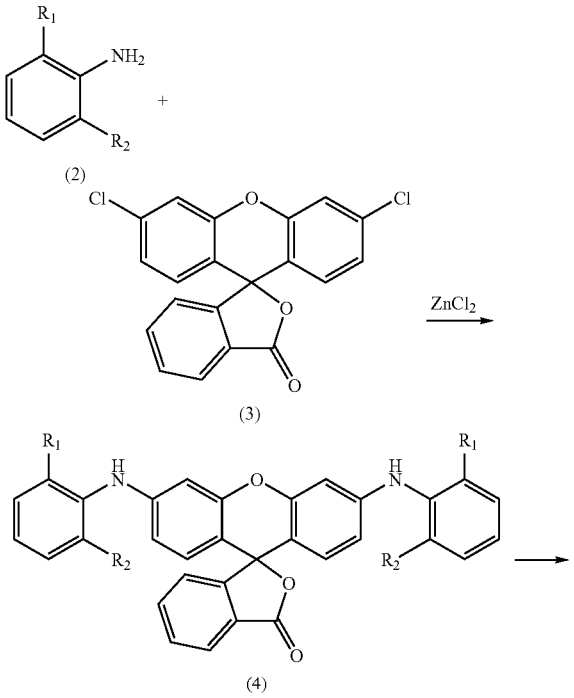

-continued

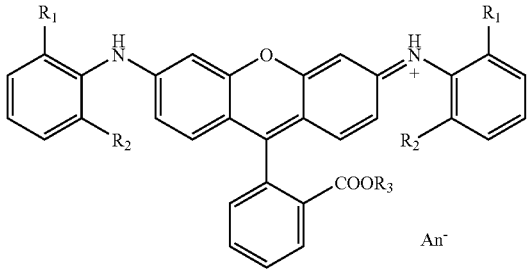

(1)

As shown above, first, 2,6-dialkylaniline (2) and 3,6-dichlorofluorane (3) are heated in the presence of zinc chloride in an organic solvent (or in the absence of a solvent) to effect condensation (first step: condensation). Next, the leuco product formed in this first step is esterified to obtain the coloring compound (1) according to the present invention (second step: esterification). Finally, the coloring compound (1) thus obtained is dissolved in an organic solvent to effect salt interchange with a sodium salt of the intended anion to obtain the desired coloring compound having the anion as a counter ion (third step: salt interchange).

The organic solvent usable in the first step of the above synthesis scheme may include high-boiling solvents. For example, it is preferable to use ethylene glycol, N-methylpyrrolidone, dichlorobenzene, sulforane or the like. The reaction may be carried out at a temperature within the range of from 150 to 220° C., and preferably from 170 to 220° C.

In the esterification in the second step of the above synthesis scheme, available are a method in which the product is allowed to react with the corresponding alcohol ($R_3OH$) in the presence of an acid catalyst and a method in which the product is allowed to react with an alkyl halide ($R_3X$, where X is a halogen) or a dialkyl sulfate [$(R_3)_2SO_4$], either of which is applicable in the present invention.

As the acid catalyst used in this case, usable are any of acids used in usual esterification, such as sulfuric acid, hydrochloric acid (hydrogen chloride), p-toluenesulfonic acid and so forth. In particular, it is preferable to use hydrogen chloride. Also, the reaction may usually be carried out at a temperature of from 20 to 120° C. The coloring compound (1) obtained here forms the counter ion of the anion of the acid used as the catalyst.

In the salt interchange in third step, there are no particular limitations on the organic solvent usable therein, which may preferably be a protonic organic solvent such as alcohol. Also, the reaction in the third step may usually be carried out at a temperature of from 20 to 100° C.

The final product obtained through the above first to third steps may be treated by a method of post-treatment in usual organic synthesis reactions, and thereafter purified so as to be used in the intended uses. Incidentally, reaction products obtained in Synthesis Examples given later are identified by $^1H$ and $^{13}C$ nuclear magnetic resonance (NMR) analysis (ECA-400, manufactured by JEOL Ltd.) and by HPLC (high-speed liquid chromatograph) analysis.

In the present invention, the coloring compound having the structure represented by the above Formula (1) may be used together with other colorant in the form of a mixture. It may preferably be used in the form of a mixture with a pigment.

The pigment usable together with the coloring compound having the structure represented by the above Formula (1)

may include quinacridone pigments, azo pigments, perylene pigments and anthraquinone pigments, such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57:1, 58, 60, 63, 64, 68, 81, 83, 87, 88, 89, 90, 112, 114, 122, 123, 146, 147, 149, 150, 163, 177, 202, 26, 207, 209, and C.I. Pigment Violet 19.

In particular, C.I. Pigment Red 122 and C.I. Pigment Red 57:1 are preferred as magenta colorants.

In the magenta toner of the present invention, the use of the coloring compound having the structure represented by the above Formula (1) and any of the above pigments in combination as colorants enables more improvement in various properties required as a color toner, in particular, spectral reflection properties and light-fastness.

The colorant usable together with the coloring compound having the structure represented by the above Formula (1) is by no means limited to the specific examples of colorants as enumerated above. Also, two or more types of colorants may be used in the form of a mixture.

In the magenta toner of the present invention, the coloring compound having the structure represented by the above Formula (1) may preferably be contained in an amount of from 1 to 60 parts by weight, and particularly preferably from 5 to 50 parts by weight, based on 100 parts by weight of the colorant. If the coloring compound having the structure represented by the above Formula (1) is added in an amount of more than 60 parts by weight, a low light-fastness may result. If on the other hand it is added in an amount of less than 1 part by weight, low hue and transparency may result.

As total weight of the colorants, in view of the achievement of proper image density and dispersibility and from the viewpoint of economical advantages, the colorants may preferably be in an amount of from 0.5 to 7 parts by weight, and more preferably from 1 to 6 parts by weight, based on 100 parts by weight of toner particles.

The process for producing the magenta toner of the present invention is described below. As the process for producing the magenta toner of the present invention, a production process may be used which utilizes a pulverization process or a polymerization process such as suspension polymerization or emulsion polymerization. In particular, it may preferably be a polymerization process, and more preferably a suspension polymerization process.

Next, the process for producing the magenta toner of the present invention is described taking the case of the suspension polymerization. It is preferable that, first, the coloring compound having the structure represented by the above Formula (1) and a polymerization initiator are mixed to prepare a polymerizable monomer composition, then the polymerizable monomer composition is dispersed in an aqueous medium to form particles of the polymerizable monomer composition, and a polymerizable monomer in the particles of of the polymerizable monomer composition is polymerized in the aqueous medium to form magenta toner particles.

To more specifically describe the above process for producing toner particles, as a polymerizable monomer composition, at least a polymerizable monomer, the coloring compound and a polymerization initiator and optionally other additives (a charge control agent and a release agent) are uniformly dispersed or dissolved to prepare the polymerizable monomer composition. Then the polymerizable monomer composition is dispersed in an aqueous medium containing a dispersion stabilizer, by means of a homogenizer or the like. Preferably, stirring speed and stirring time are so controlled that monomer droplets may have the desired toner particle size, in general, particle diameters of 30 μm or less, to carry out granulation. Thereafter, the particles in the polymerizable monomer system are kept in a stable condition by the action of the dispersion stabilizer so that they can have a specific deformed shape and surface properties, and also agitation is carried out to such an extent that the particles of the polymerizable monomer composition can be prevented from settling. Thus, the polymerization proceeds stably without causing any agglomeration of particles or coalescence of particles along the progress of polymerization reaction. The polymerization may be carried out at a polymerization temperature set at 40° C. or more, commonly from 50 to 90° C. At the latter half of the polymerization, the temperature may be raised, and also the aqueous medium may partly be evaporated off at the latter half of the reaction or after the reaction has been completed, in order to remove unreacted polymerizable monomers, by-products and so forth which are causative of a smell at the time of toner fixing. After the reaction has been completed, the toner particles formed are, after the dispersion stabilizer has been removed, well washed with water, and thereafter the toner particles are collected by filtration and then dried, followed optionally by classification to obtain magenta toner particles.

The polymerizable monomer, coloring compound, charge control agent, release agent, polymerization initiator and other additives that constitute the polymerizable monomer composition used in the present invention may include the following.

The polymerizable monomer may include styrene monomers such as styrene, o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and besides, monomers such as acrylonitrile, methacrylonitrile and acrylamide. These monomers may each be used alone or in the form of a mixture of any of these.

The charge control agent includes a negative charge control agent and a positive charge control agent. The negative charge control agent may include metal-containing salicylic acid compounds, metal-containing monoazo dye compounds, styrene-acrylic acid copolymers, imidazole derivatives, styrene-methacrylic acid copolymers (N,N'-diaryl urea derivatives), and carixarene.

The positive charge control agent may include Nigrosine, and Nigrosine modified products modified with a fatty acid metal salt; quaternary ammonium salts such as tributylbenzylammonium 1-hydroxy-4-naphthosulfonate, tetrabutylammonium tetrafluoroborate, and analogues of these, onium salts such as phosphonium salts, and lake pigments of these; triphenylmethane dyes and lake pigments of these (a lake forming agent may include tungstophosphoric acid, molybdophosphoric acid, tungstomolybdophosphoric acid, tannic acid, lauric acid, gallic acid, ferricyanides and ferrocyanides); metal salts of higher fatty acid; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more types.

The release agent may preferably include hydrocarbon waxes. Stated specifically, it may include paraffin and polyolefin waxes, and modified products thereof, e.g., oxides or graft-treated products; and besides higher fatty acids, and metal salts thereof; amide waxes. It may more preferably include non-polar ones such as paraffin wax. Where such a non-polar wax is used, the wax can localize at the cores of toner particles and at the same time can promote localization of polar groups to toner particle surfaces. The release agent may preferably be in a content of from 5 to 30 parts by weight based on 100 parts by weight of the toner particles. If it is in a content of less than 5 parts by weight, the effect of promoting localization of polar groups to toner particle surfaces may come small. If on the other hand it is in a content of more than 30 parts by weight, the effect of promoting localization may be obtained but the toner may have low anti-blocking properties.

The polymerization initiator may include, e.g. azo or diazo type polymerization initiators such as 2,2'-azobis-(2,4-dimethylvaleronitrile), 2,2'-azobisisobutyronitrile, 1,1'-azobis-(cyclohexane-1-carbonitrile), and 2,2'-azobis-(4-methoxy-2,4-dimethylvaleronitrile); and peroxide type initiators or polymeric initiators having a peroxide in the side chain, such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl)propane, and tris-(t-butoxyperoxy)triazine; persulfates such as potassium persulfate and ammonium persulfate; and hydrogen peroxide; any of which may be used.

The polymerization initiator may preferably be added in an amount of from 0.5 to 20 parts by weight based on 100 parts by weight of the polymerizable monomer, and may be used alone or in combination.

In the present invention, in order to control molecular weight, any known cross-linking agent or chain transfer agent may also be added as other additive, which may preferably be added in an amount of from 0.001 to 15 parts by weight based on 100 parts by weight of the polymerizable monomer.

As a cross-linking agent preferably used, it may include divinylbenzene, divinylnaphthalene, and their derivatives aromatic divinyl compounds; and besides diethylenic carboxylates such as ethylene glycol dimethacrylate, diethylene glycol methacrylate, triethylene glycol methacrylate, trimethylolpropane triacrylate, allyl methacrylate, tert-butylaminoethyl methacrylate, tetraethylene glycol dimethacrylate and 1,3-butanediol dimethacrylate; all sorts of divinyl compounds such as N-N-divinylanline, divinyl ether, divinyl sulfide and divinyl sulfone; and compounds having three or more vinyl groups; any of which may be used alone or in the form of a mixture or the like.

In the present invention, a polar polymer or polar copolymer having a carboxyl group may also be added to the polymerizable monomer composition to carry out polymerization.

The polar polymer or polar copolymer usable in the present invention may include polar polymer or polar copolymers making use of unsaturated carboxylic acids such as acrylic acid and methacrylic acid, other unsaturated dibasic acids, or unsaturated dibasic anhydrides, and unsaturated or saturated polyesters.

Any of these polar polymers or polar copolymers may preferably be used in an amount of from 1 to 35 parts by weight, and more preferably from 5 to 20 parts by weight, based on 100 parts by weight of the polymerizable monomer. If it is in an amount of more than 35 parts by weight, the polymerizable monomer composition may have a high viscosity, resulting in unstable granulation.

In the present invention, in order to stabilize the granulation in the aqueous medium, a dispersion stabilizer may also be added to the aqueous medium. As the dispersion stabilizer usable in the present invention, it may include, as inorganic dispersants, calcium phosphate, hydroxylapatite, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. As organic compounds, it may include polyvinyl alcohol, gelatin, methyl cellulose, methyl hydroxypropyl cellulose, ethyl cellulose, carboxymethyl cellulose sodium salt, polyacrylic acid and salts thereof, and starch.

It is considered that these dispersion stabilizers prevent polymerizable monomer composition particles from agglomerating mutually which are present in the form of droplets dispersed uniformly in aqueous mediums and further adsorb uniformly on the surfaces of these droplets to make the droplets stable. After the polymerization reaction of polymerizable monomers in the droplets has been completed, these dispersion stabilizers are solubilized by acid or alkali treatment or through washing with hot water, and separated from toner particles.

In particular, as a dispersion stabilizer, calcium phosphates are readily removable from the toner particle surfaces only by acid treatment and water washing. Thus, they are effective because colorants, pigment dispersing agents and charge control agents may neither become decomposed nor become dissolved out and also any thermal deformation need not be taken into account.

The calcium phosphates herein referred to includes calcium phosphate, calcium hydrogenphosphate, calcium dihydrogenphosphate, hydroxylapatite and a mixture of some of these. Taking account of the size of crystals of these salts, the particle diameter of crystal agglomerates, the effect of solubility to acids, and so forth, hydroxylapatite and calcium phosphate are preferred. In particular, hydroxylapatite is most preferred.

As to these calcium phosphates, a calcium phosphate may be formed from an aqueous phosphate solution and an aqueous calcium salt solution in an aqueous medium, and be put into use. Such a method is particularly effective when it is used as the dispersant, because any agglomerates do not form and uniform fine-particle crystals can be obtained. When powdery calcium phosphates are used as they are, they tend to become strong agglomerates as powder, which agglomerates may have non-uniform particle diameter and can be dispersed in the aqueous phase quite with difficulty. As an additional advantage of the method of forming the calcium phosphates in the aqueous medium, water-soluble neutral salts formed as by-products in the calcium phosphates have the effect of preventing the polymerizable monomer from dissolving in water and the effect of making the specific gravity of the aqueous medium greater.

External additives usable in the present invention may include, e.g., oxides such as alumina, titanium oxide, silica, zirconium oxide and magnesium oxide, and besides silicon carbide, silicon nitride, boron nitride, aluminum nitride, magnesium carbonate and organosilicon compounds.

It is preferable for the above external additive fine powder to have been subjected to hydrophobic treatment so that the toner can be less dependent on environment such as temperature and humidity and also the fine powder can be prevented from coming off toner particle surfaces. An agent for this hydrophobic treatment may include, e.g., coupling agents such as silane coupling agents, titanium coupling agents and, aluminum coupling agents, and oils such as silicone oil, fluorine type oils and various modified oils.

Of these known external additives, silica, alumina, titania or double oxides thereof may preferably be selected in order to improve charging stability, developing performance, fluidity and storage stability. In particular, silica is more preferred in view of an advantage that coalescence of primary particles can be controlled arbitrarily to a certain extent in accordance with starting materials or oxidation conditions such as temperature. Such silica includes, e.g., what is called dry-process silica or fumed silica produced by vapor phase oxidation of silicon halides or alkoxides and what is called wet-process silica produced from alkoxides or water glass, either of which may be used. The dry-process silica is more preferred, as having less silanol groups on the surface and inside and leaving no production residue. In the dry-process silica, it is also possible to use, in its production step, e.g., other metal halide such as aluminum chloride or titanium chloride together with the silicon halide to obtain a composite fine powder of silica with other metal oxide. The silica may include these as well.

The external additive may preferably be added in an amount of from 0.1 to 3 parts by weight based on 100 parts by weight of the toner particles in order to make toner's charge quantity stable, to make its bulk density stable and to make its stability higher when left in an environment of high humidity. Any of these external additives may be used in combination of two or more. External additives which may preferably further additionally be used in combination are described below.

In order to improve transfer performance and/or cleaning performance, inorganic or organic closely spherical fine particles having a primary particle diameter of 50 nm or more (preferably having a specific surface area of less than 50 $m^2/g$) may further be added. This is also one of the preferred embodiments. For example, spherical silica particles, spherical polymethyl silsesquioxane particles and spherical resin particles may preferably be used.

In the toner of the present invention, other additives may also be used as long as they do not have any substantial ill effects, which may include, e.g., lubricant powders such as polyethylene fluoride powder, zinc stearate powder and polyvinylidene fluoride powder; abrasives such as cerium oxide powder, silicon carbide powder and strontium titanate powder; anti-caking agents such as titanium oxide powder and aluminum oxide powder; and conductivity-providing agents such as carbon black powder, zinc oxide powder and tin oxide powder. Reverse-polarity organic particles and inorganic particles may also be used in a small quantity as a developability improver.

The toner according to the production process of the present invention may usually be used in any developers as a one-component developer or as a two-component developer. For example, when used as the one-component developer, a method is available in which the toner is transported by charging it forcedly triboelectrically on a developing sleeve to cause it to adhere onto the sleeve, using a blade or a fur brush.

As for the case in which the toner is used as the two-component developer, a carrier is used together with the toner of the present invention, which is used as the developer. There are no particular limitations on the carrier used. It is chiefly constituted solely of iron, copper, zinc, nickel, cobalt, manganese or chromium element, or in the state of a composite ferrite. The shape of carrier particles is also important in view of an advantage that the saturation magnetization and electrical resistivity can be controlled in a wide range. For example, it is preferable to select spherical, flat or shapeless particles and also to control the microstructure of carrier particle surfaces, e.g., surface unevenness. What is commonly used is a method in which the inorganic oxide is fired and granulated to beforehand produce carrier core particles, which are thereafter coated with a resin. From the meaning of decreasing the load of carrier to toner, it is also possible to use a method in which the inorganic oxide and the resin are kneaded, followed by pulverization and classification to obtain a low-density dispersed carrier, and also a method in which a kneaded product of the inorganic oxide and a monomer is directly subjected to suspension polymerization in an aqueous medium to obtain a true-spherical dispersed carrier.

The system in which the carrier particle surfaces are coated with a resin is particularly preferred. As methods for such coating, available are a method in which a coat material such as the resin is dissolved or suspended in a solvent, followed by coating to make it adhere to carrier particles, and a method in which the coat material such as the resin is mixed with carrier particles to make the coat material adhere to the carrier particles. Any of such conventionally known methods may be used.

The material to be coated on the carrier particle surfaces may differ depending on toner materials. For example, it is suitable to use, alone or in combination, polytetrafluoroethylene, monochlorotrifluoroethylene polymer, polyvinylidene fluoride, silicone resin, polyester resin, a metal compound of di-tertiary-butylsalicylic acid, styrene resin, acrylic resin, polyamide, polyvinyl butyral, Nigrosine, aminoacrylate resin, a basic dye or a lake compound thereof, fine silica powder and fine alumina powder, but not necessarily limited to these.

In the treatment, the above coat material may preferably be used in an amount of from 0.1 to 30% by weight, and more preferably from 0.5 to 20% by weight, in total based on 100 parts by weight of the carrier.

The carrier may preferably have an average particle diameter of from 10 to 100 μm, and more preferably from 20 to 50 μm.

As a particularly preferred embodiment, the carrier may include a coated ferrite carrier comprising Cu—Zn—Fe three-component ferrite particles whose surfaces are coated with a mixture composed of a combination of resins such as a fluorine resin and a styrene resin, e.g., a combination of polyvinylidene fluoride with styrene-methyl methacrylate resin, polytetrafluoro-ethylene with styrene-methyl methacrylate resin or a fluorine type copolymer with a styrene type copolymer, in a ratio of from 90:10 to 20:80, and preferably from 70:30 to 30:70 (weight ratio), and in a coating weight of from 0.01 to 5 parts by weight, and preferably from 0.1 to 1 parts by weight, based on 100 parts by weight of the ferrite, containing 250 mesh-pass and 400 mesh-on carrier particles in an amount of 70 parts by weight or more based on 100 parts by weight of the whole carrier particles, and having the above average particle diameter. The fluorine type copolymer is exemplified by a vinylidene fluoride-tetrafluoroethylene copolymer (10:90 to 90:10) and the styrene type copolymer is exemplified by a styrene-2-ethylhexyl acrylate copolymer (20:80 to 80:20) and a styrene-2-ethylhexyl acrylate-methyl methacrylate terpolymer (20 to 60:5 to 30:10 to 50).

The above coated ferrite carrier has a sharp particle size distribution, can provide a triboelectric chargeability preferable for the toner of the present invention, and also is effective in improving electrophotographic performances.

Where the two-component developer is prepared by blending the toner according to the present invention and the carrier, good results can usually be obtained when they are blended in such a proportion of from 2 to 15% by weight, and preferably from 4 to 13% by weight, as toner concentration in the developer. If the toner concentration is less than 2% by weight, a low image density may result. If it is more than 15% by weight, fog and in-machine toner scatter may occur to shorten the service life of the developer.

The carrier may preferably have the following magnetic properties. Magnetization intensity at 79.58 kA/m (1,000 oersted) after having magnetically been saturated is required to be from 30 to 300 emu/$cm^3$. In order to achieve a higher image quality, it is more preferably from 100 to 250 emu/$cm^3$. If it is greater than 300 emu/$cm^3$, it is difficult to obtain toner images with a high image quality. If it is less than 30 emu/$cm^3$, carrier adhesion tends to occur because of a decrease in magnetic binding force.

The present invention is described below in greater detail by giving Examples and Comparative Examples. The present invention is by no means limited to these Examples. In the following, "part(s)" in formulation refers to "part(s) by weight" in all occurrences.

EXAMPLE 1

Preparation of Aqueous Medium

In 710 parts of ion-exchanged water, 450 parts of an aqueous 0.1 M $Na_3PO_4$ solution was introduced, followed by heating to 60° C. and then stirring at 12,000 rpm using a TK-type homomixer (manufactured by Tokushu Kika Kogyo Co., Ltd.). To the resultant mixture, 68 parts of an aqueous 1.0 M $CaCl_2$ solution was added to obtain an aqueous medium containing fine particles of $Ca_3(PO_4)_2$.

Preparation of polymerizable monomer composition:

| | |
|---|---|
| Styrene monomer | 85 parts |
| n-Butyl acrylate monomer | 15 parts |
| Coloring compound (the above Exemplary Structure 2) | 2 parts |
| C.I. Pigment Red 122 (the following structural formula a) | 3 parts |
| Structural formula a: | |

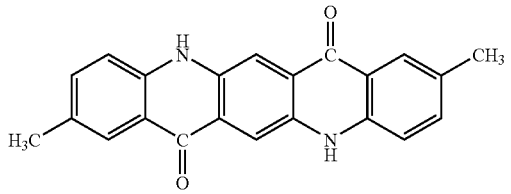

| | |
|---|---|
| Styrene-methacrylic acid-methyl methacrylate copolymer (acid value: 70; Mw: 50,000; Mw/Mn: 2.0) | 7.5 parts |
| Di-t-butylsalicylic acid aluminum compound | 0.9 part |
| Paraffin wax (m.p.: 70° C.) | 15 parts |

Materials formulated as above were heated to 60° C. and uniformly dissolved or dispersed by means of the TK-type homomixer at 12,000 rpm. To the mixture obtained, 5 parts of a polymerization initiator 2,2'-azobis(2,4-dimethylvaleronitrile) was dissolved to prepare a polymerizable monomer composition.

The polymerizable monomer composition was introduced into the above aqueous medium, followed by stirring for 10 minutes at 60° C. in an atmosphere of nitrogen, using the TK-type homomixer at 15,000 rpm to granulate the polymerizable monomer composition. Thereafter, the granulated product obtained was stirred with a paddle stirring blade during which the temperature was raised to 70° C., where the reaction was carried out for 10 hours. After the polymerization reaction was completed, residual monomers were evaporated off under reduced pressure, the reaction system was cooled, and thereafter hydrochloric acid was added thereto to dissolve hydroxylapatite, followed by filtration, washing with water and then drying to obtain polymerization toner particles. To 100 parts of the particles obtained, 0.5 part of hydrophobic-treated fine silica powder was externally added to make up a magenta toner. With 5 parts of this toner, 95 parts of acryl-coated ferrite carrier was blended to make up a developer.

A full-color copying machine CLC-500, manufactured by CANON INC., was altered in the following way. The distance between the developing assembly and the photosensitive drum was set at 400 μm, and the peripheral speed ratio of the developing sleeve to the photosensitive drum was set at 1.3:1. In the developing assembly, the intensity of magnetic fields of developing poles was set at 1,000 oersteds; the alternating electric field, 2,000 Vpp; frequency, 3,000 Hz; and the distance between the developing sleeve and the photosensitive drum, 500 μm.

Using the above developer in the above CLC-500 altered machine, image reproduction was evaluated to find that good images with a stable and sharp magenta color were obtained without any lowering of developing performance even after 20,000-sheet running.

EXAMPLE 2

A magenta toner was obtained in entirely the same manner as in Example 1 except that the coloring compound of the above Exemplary Structure 2 was changed for the coloring compound of the above Exemplary Structure 3. On the magenta toner obtained, the running evaluation was made in the same manner as in Example 1 to find that good images with a stable and sharp magenta color were obtained without any lowering of developing performance even after 20,000-sheet running.

EXAMPLE 3

A magenta toner was obtained in entirely the same manner as in Example 1 except that, in place of 4 parts of the coloring compound of the above Exemplary Structure 2 and 6 parts of C.I. Pigment Red 122 (structural formula a), 8 parts of the coloring compound of the above Exemplary Structure 2 was used. On the magenta toner obtained, the running evaluation was made in the same manner as in Example 1 to find that good images with a stable and sharp magenta color were obtained without any lowering of developing performance even after 20,000-sheet running.

COMPARATIVE EXAMPLE 1

A magenta toner was obtained in entirely the same manner as in Example 1 except that, in place of 4 parts of the coloring compound of the above Exemplary Structure 2 and 6 parts of C.I. Pigment Red 122 (structural formula a), 12 parts of C.I. Pigment Red 122 (structural formula a) was used. On the magenta toner obtained, the running evaluation was made in the same manner as in Example 1 to find that good images with a stable and sharp magenta color were obtained without any lowering of developing performance even after 20,000-sheet running.

COMPARATIVE EXAMPLE 2

A magenta toner was obtained in entirely the same manner as in Example 1 except that, in place of 4 parts of the coloring compound of the above Exemplary Structure 2 and 6 parts of C.I. Pigment Red 122 (structural formula a), 12 parts of C.I. Solvent Red 49 (the following structural formula b) was used. On the magenta toner obtained, the running evaluation was made in the same manner as in Example 1 to find that fog occurred at running on 10,000 sheets.

Structural formula b:

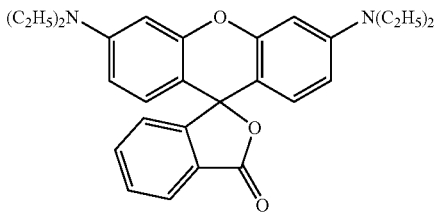

Light-fastness test:

Solid images were copied with the above full-color copying machine, and the solid images formed were irradiated by xenon light (illumination: 765 w/m$^2$; temperature: 50° C.) for 20 hours using SUNTESTER XF-180CPS (manufactured by Shimadzu Corporation). Color difference ΔE before and after testing was measured with GRETAG MACBETH SPECTROLINO (manufactured by Gretag Macbeth Holding AG) to make evaluation according to the following criteria.

A: ΔE is less than 5.

B: ΔE is 5 or more to less than 10.

C: ΔE is 10 or more.

OHP transparency:

Solid images were copied on OHP sheets in an OHP mode, and were projected through a projector to observe the transparency of solid images to make evaluation according to the following criteria.

A: No problem on transparency.

B: Transparency is a little poor.

C: Images stand fairly cloudy.

Spectral reflectance:

On the solid images copied with the above full-color copying machine, L*, a* and b* were measured with GRETAG MACBETH SPECTROLINO, and their chroma (C*) was determined to make evaluation according to the following criteria.

A: The chroma is 80 or more.

C: The chroma is less than 80.

The results of the foregoing are shown in Table 2.

TABLE 2

| | Colorant(s) | Light = resistance test | OHP trans-parency | Chroma |
|---|---|---|---|---|
| Example: | | | | |
| 1 | Exemplary Structure 2 + structural formula a | A | A | A |
| 2 | Exemplary Structure 3 + structural formula a | A | A | A |
| 3 | Exemplary Structure 2 | B | A | A |
| Comparative Example: | | | | |
| 1 | Structural formula a | A | B | C |
| 2 | Structural formula b | C | A | A |

As is evident from Table 2, the polymerization magenta toners of Examples 1 to 3, which contains at least the coloring compound having the structure represented by the above Formula (1), proved to be better than the polymerization magenta toners of Comparative Examples 1 and 2 in respect of all the light-fastness, OHP transparency and spectral reflectance.

This application claims a priority from Japanese Patent Application No. 2004-058671 filed on Mar. 3, 2004, the contents of which are incorporated hereinto by reference.

What is claimed is:

1. A magenta toner comprising magenta toner particles containing at least a coloring compound having a structure represented by the following Formula (1):

Formula (1)

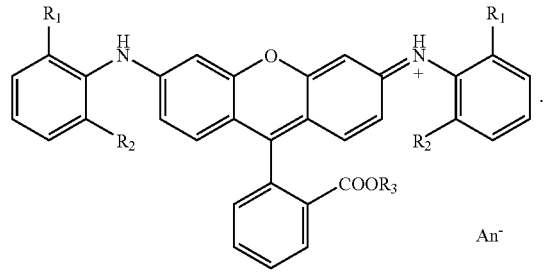

wherein $R_1$ and $R_2$ each independently represent a straight-chain alkyl group having 1 to 4 carbon atoms, $R_3$ represents an alkyl group having 1 to 6 carbon atoms, and $An^-$ represents a counter anion, wherein said magenta toner particles are polymerization magenta toner particles formed by granulating in an aqueous medium a polymerizable monomer composition containing at least a polymerizable monomer, the coloring compound having the structure represented by the above Formula (1) and a polymerization initiator, and polymerizing the polymerizable monomer.

2. The magenta toner according to claim 1, wherein $R_1$ and $R_2$ are each independently a methyl group or an ethyl group.

3. The magenta toner according to claim 1, wherein $R_3$ is a methyl group or an ethyl group.

4. The magenta toner according to claim 1, wherein $An^-$ is at least one ion selected from the group consisting of a halide ion (halogenide ion), a sulfate ion ($SO_4^{2-}$), a perchlorate ion ($ClO_4^-$), a tetrafluoroborate ion ($BF_4^-$), a hexafluorophosphate ion ($PF_6^-$), a methacrylate ion ($CH_2C$ $(CH_3)COO^-$), a p toluenesulfonate ion ($CH_3C_6H_4SO_3^-$), a fatty acid ion ($R—COO^-$) and an aromatic carboxylate ion ($Ar\ COO^-$).

5. The magenta toner according to claim 4, wherein $An^-$ is an aromatic carboxylate ion.

6. A process for producing a magenta toner having magenta toner particles, comprising:

mixing at least a polymerizable monomer, a coloring compound having a structure represented by the following Formula (1) and a polymerization initiator to prepare a polymerizable monomer composition;

dispersing the polymerizable monomer composition in an aqueous medium to form particles of the polymerizable monomer composition; and polymerizing in the aqueous medium a polymerizable monomer contained in the particles of the polymerizable monomer composition to form the magenta toner of claim 1:

Formula (1)

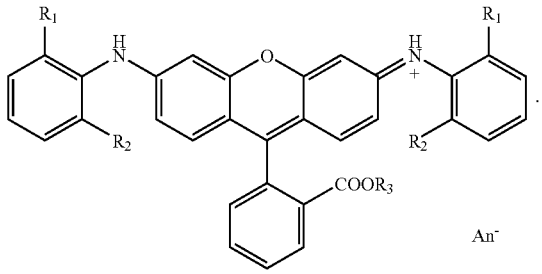

wherein $R_1$ and $R_2$ each independently represent a straight chain alkyl group having 1 to 4 carbon atoms, $R_3$ represents an alkyl group having 1 to 6 carbon atoms, and $An^-$ represents a counter anion.

* * * * *